US005617979A

United States Patent [19]

Cavender

[11] Patent Number: 5,617,979

[45] Date of Patent: Apr. 8, 1997

[54] BOW MAKING APPARATUS

[76] Inventor: Deborah L. Cavender, 2825 Top Rd., Sevierville, Tenn. 37862

[21] Appl. No.: 371,295

[22] Filed: Jan. 11, 1995

Related U.S. Application Data

[63] Continuation-in-part of Ser. No. 133,618, Oct. 7, 1993, abandoned.

[51] Int. Cl.[6] ..... A41H 43/00

[52] U.S. Cl. ..... 223/46; 223/44

[58] Field of Search ..... 223/44, 46; 28/147, 28/149, 150; 428/4

[56] References Cited

U.S. PATENT DOCUMENTS

| | | | |
|---|---|---|---|
| 696,361 | 3/1902 | Chase . | |
| 1,010,155 | 11/1911 | Lange . | |
| 1,598,310 | 8/1926 | Quinlan . | |
| 2,077,370 | 4/1937 | Reynolds | 223/46 |
| 2,105,436 | 1/1938 | Flatto | 132/47 |
| 2,542,222 | 2/1951 | Welch | 223/46 |
| 2,569,943 | 10/1951 | Mitchell | 223/46 |
| 2,666,249 | 1/1954 | Ruiz et al. | 28/2 |
| 2,763,080 | 9/1956 | Welch | 41/10 |
| 3,223,440 | 12/1965 | Rosenzweig | 289/1.2 |
| 3,377,674 | 4/1968 | Brassaw et al. | 28/2 |
| 3,428,227 | 2/1969 | Cavoli | 223/46 |
| 3,462,049 | 8/1969 | Smith | 223/46 |
| 3,501,070 | 3/1970 | Shattuck | 223/46 |
| 3,816,888 | 6/1974 | Rather, Jr. | 28/2 |
| 3,854,179 | 12/1974 | Montoya | 28/2 |
| 4,337,578 | 7/1982 | Seals | 33/125 R |
| 4,454,968 | 6/1984 | St. Lawrence | 223/46 |
| 4,629,100 | 12/1986 | Owens | 223/46 |
| 4,714,182 | 12/1987 | Hecht | 223/46 |
| 5,100,706 | 3/1992 | Zaweski | 428/4 |
| 5,215,791 | 6/1993 | Davignon | 428/5 |
| 5,411,188 | 5/1995 | Teuten | 223/44 |

*Primary Examiner*—Bibhu Mohanty
*Attorney, Agent, or Firm*—Pitts & Brittian, P.C.

[57] ABSTRACT

A bow making apparatus (10) for receiving and maintaining the disposition of bow fabricating material during the making of a decorative bow. The bow making apparatus (10) includes a base member (12) defining an upper work surface (14) for supporting bow fabricating material (28) during the bow making operation. The apparatus (10) also includes first, second and third retainer members (22, 24,25) extending upwardly from the upper work surface (14) of the base member (12) for releasably receiving and maintaining the position of gathered sections of bow fabricating material (28).

10 Claims, 5 Drawing Sheets

BOW MAKING APPARATUS

This application is a continuation-in-part and discloses and claims subject matter disclosed in my earlier filed pending application, Ser. No. 08/133,618 filed on Oct. 7, 1993, now abandoned.

TECHNICAL FIELD

This invention relates a bow making apparatus for receiving and maintaining the disposition of bow fabricating material during the making of a decorative bow. In this particular invention the apparatus includes a plurality of selectively spaced retainer members disposed on the upper work surface of a base member.

BACKGROUND ART

Decorative bow making has long been recognized as an art, and substantial skill is generally required to manually tie well proportioned decorative bows. Of course, automation of the bow making industry has given rise to complex machinery for producing decorative bows, but such machinery is expensive and takes originality, creativity and, indeed, enjoyment, out of the bow making process. Attempts have been made to devise bow making devices that are inexpensive, but they too tend to limit the bow maker's creativity by dictating the resulting bow configuration. Examples of such devices are disclosed in the following U.S. Patents:

| U.S. Pat. No. | Inventor(s) | Issue Date |
|---|---|---|
| 696,361 | E. S. Chase | Mar 25, 1902 |
| 1,010,155 | W. E. Lange | Nov 28, 1911 |
| 1,598,310 | T. A. Quinlan | Aug 31, 1926 |
| 2,077,370 | R. K. Reynolds | Apr 13, 1937 |
| 2,105,436 | G. Flatto | Jan 11, 1938 |
| 2,542,222 | A. F. Welch | Feb 20, 1951 |
| 2,666,249 | R. R. Ruiz, et al. | Jan 19, 1954 |
| 2,763,080 | A. F. Welch | Sep 18, 1956 |
| 3,223,440 | W. Rosenzweig | Dec 14, 1965 |
| 3,428,227 | J. W. Cavoli | Feb 18, 1969 |
| 3,501,070 | W. M. Shattuck | Mar 17, 1970 |
| 3,816,888 | J. B. Rather, Jr. | Jun 18, 1974 |
| 4,454,968 | J. J. St Lawrence | Jun 19, 1984 |
| 4,629,100 | B. Owens | Dec 16, 1986 |

Other devices have been produced for measuring filaments for subsequent use, such as in tassels and pompoms. Typical of the art are those devices disclosed in the following U.S. Patents:

| U.S. Pat. No. | Inventor(s) | Issue Date |
|---|---|---|
| 3,377,674 | R. F. Brassaw, et al. | Apr 16, 1968 |
| 3,854,179 | J. Montoya | Dec 17, 1974 |
| 4,337,578 | E. L. Seals | Jul 6, 1982 |

Typical bows are disclosed in the following U.S. Patents:

| U.S. Pat. No. | Inventor(s) | Issue Date |
|---|---|---|
| 5,100,706 | L. Zaweski | Mar 31, 1992 |
| 5,215,791 | E. A. Davignon | Jun 1, 1993 |

Of all of the prior art references cited, none teaches a device for fabricating a decorative bow wherein the device serves to retain the gathered portion of the bow such that the loops of the bow may be independently measured and freely maintained. Further, none of the prior art devices provides a means for independently retaining a plurality of bows.

Therefore, it is an object of the present invention to provide a bow making apparatus for receiving and maintaining the disposition of bow fabricating material during the making of a decorative bow.

It is another object of the present invention to provide a bow making apparatus which assists in the tying of a decorative bow, but does not stifle originality or creativity in the bow making operation.

Yet another object of the present invention is to provide a bow making apparatus which is simple to use and inexpensive.

DISCLOSURE OF THE INVENTION

Other objects and advantages will be accomplished by the present invention which provides a bow making apparatus for receiving and maintaining the disposition of bow fabricating material during the making of a decorative bow. The bow making apparatus includes a base member defined an upper work surface for supporting bow fabricating material during the bow making operation. The apparatus also includes at least first and second retainer members extending upwardly from the upper work surface of the base member, between which gathered sections of bow fabricating material are received and maintained. In one embodiment the first and second retainer members are selectively spaced so as to define a retaining gap therebetween for releasably receiving and maintaining the position of gathered sections of the bow fabricating material. In a further embodiment, a third retainer member extends upwardly from the upper work surface of the base member, the second and third retainer member serving in like fashion as the first and second retainer members. In this embodiment, the third retainer member is spaced closer to the second retainer member than is the first retainer member, and the third retainer member defines a height shorter than that of the first and second retainer members. Thus, the first and second retainer members aid in the fabrication of a larger bow using wider ribbon, while the second and third retainer members more appropriately aid in the fabrication of smaller bows using narrower ribbon. In a preferred embodiment of the apparatus the upper work surface of the base member is provided with measuring indicia to facilitate the making of bows having preselected dimensions.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

A bow making apparatus incorporating various features of the present invention is illustrated generally at 10 in the Figures. As will be discussed below, the apparatus 10 provides a work surface for fabricating a decorative bow and a means for retaining the ribbon or other material being used to fabricate the bow during the fabricating process.

The apparatus 10 includes a base member 12 having a substantially planar upper work surface 14, and a lower surface 16 for supporting the apparatus 10 on a table or other support surface. In the preferred illustrated embodiment the base member 12 defines an elongated rectangular configuration. However, it will be recognized that the base member 12 can assume any other geometric configuration.

Figure 8:
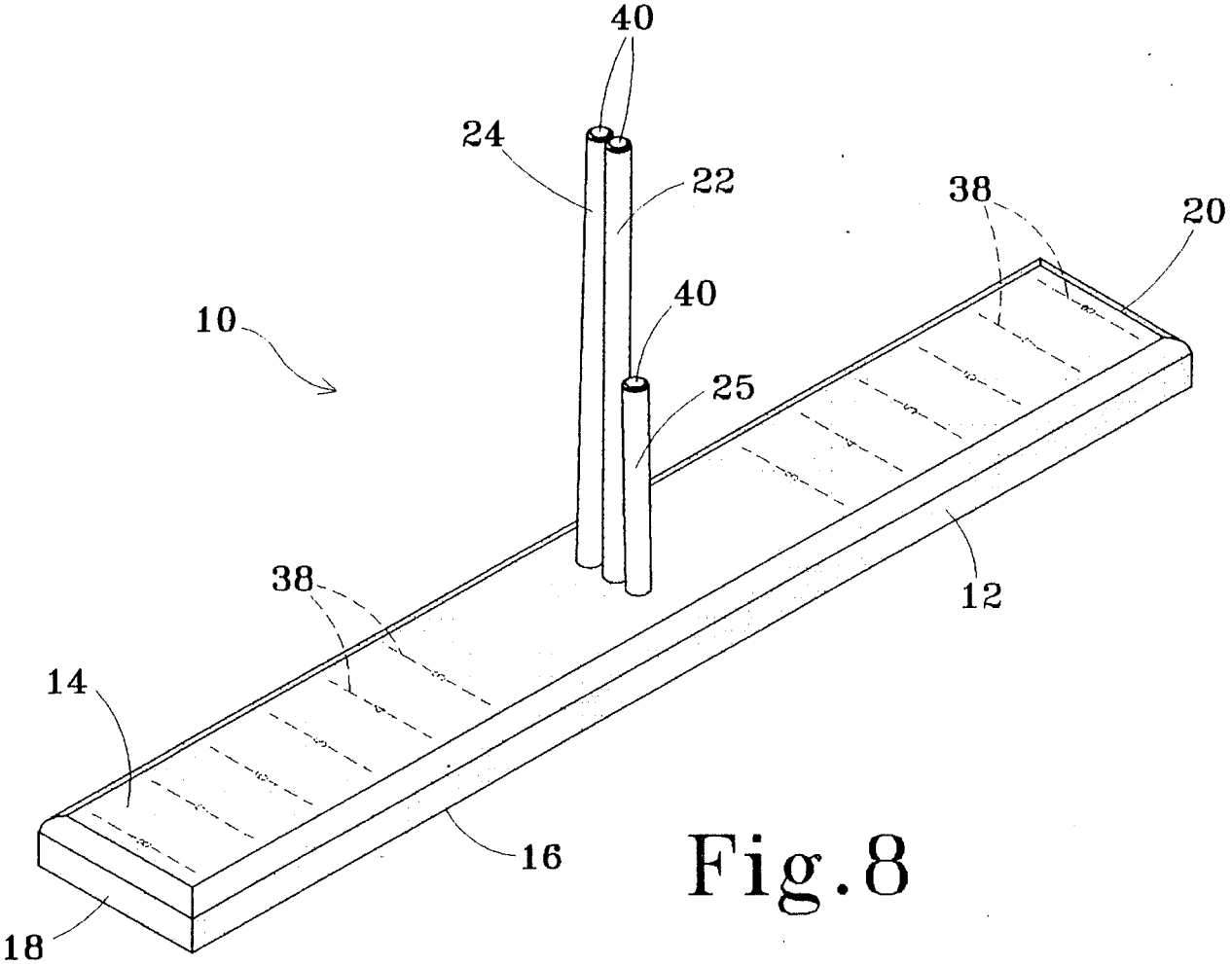
FIG. 8 illustrates a perspective view of an alternate embodiment of a bow making apparatus of the present invention.

The base member 12 has first and second opposite ends 18 and 20, respectively. Mounted between the opposite ends 18 and 20 are at least two retainer members 22 and 24. In the embodiment illustrated in FIGS. 8 and 9, first, second and third retainer members 22, 24 and 25 are provided. In the preferred embodiment the retainer members 22, 24 and 25 define elongated rods having substantially circular cross-sections, and extend upwardly from the upper work surface 14. The retainer members 22 and 24 each define a length substantially equal one to the other, while in the preferred embodiment, the retainer member 25 defines a length shorter that that of the retainer members 22 and 24. As will be discussed below, the retainer member 25 is provided to cooperate with the retainer member 22 to assist in the fabrication of bows smaller than those fabricated using the retainer members 22 and 24.

Figure 1:
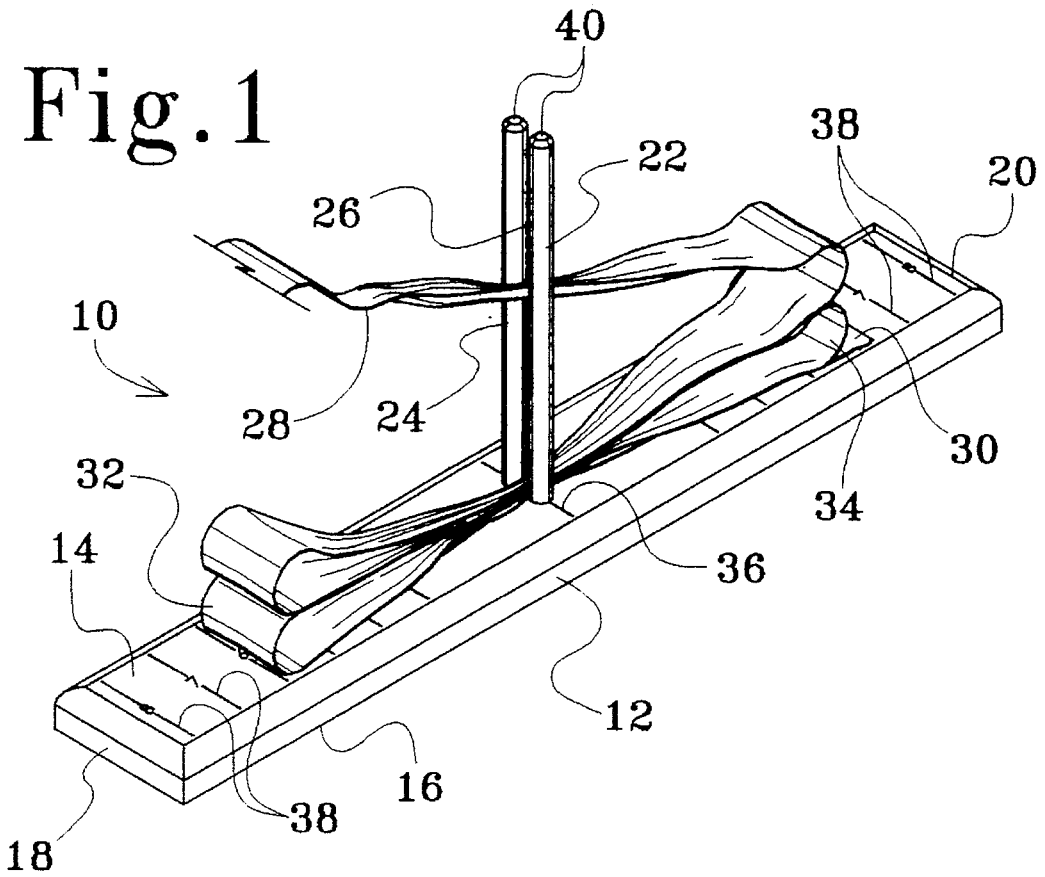
FIG. 1 illustrates a perspective view of a bow making apparatus of the present invention.
Figure 2:
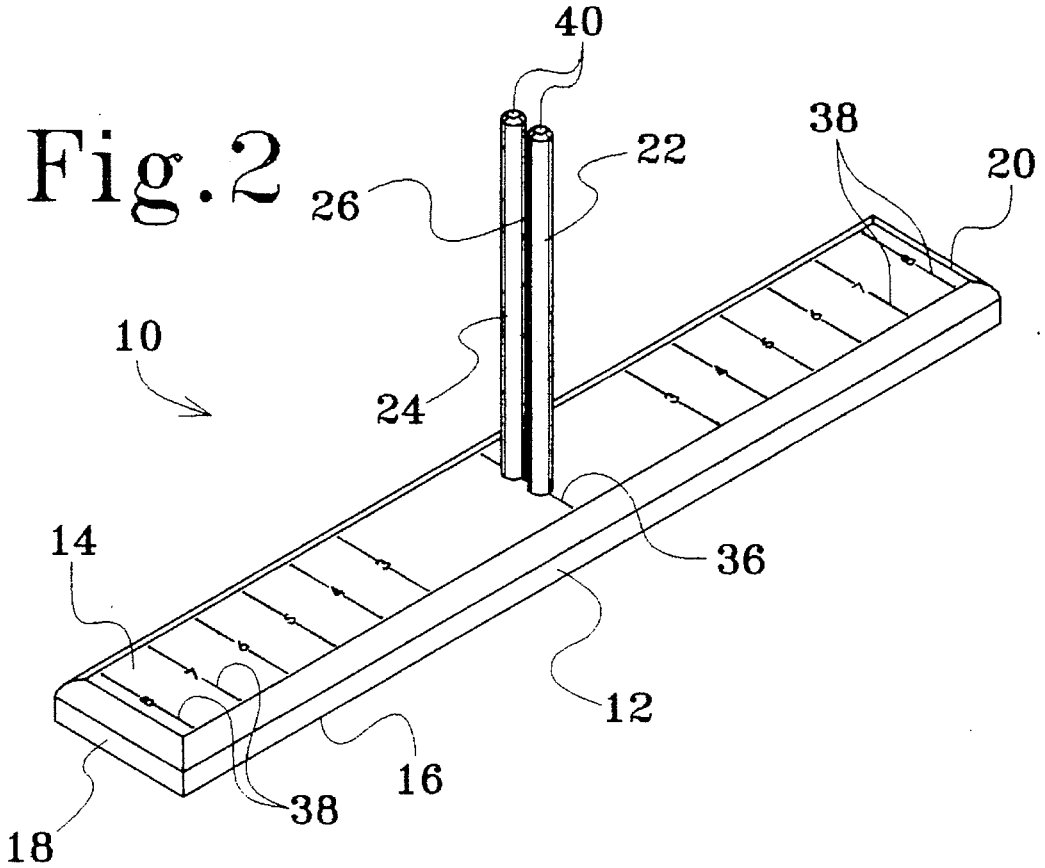
FIG. 2 illustrates a perspective view of a bow making apparatus of the present invention.
Figure 3:
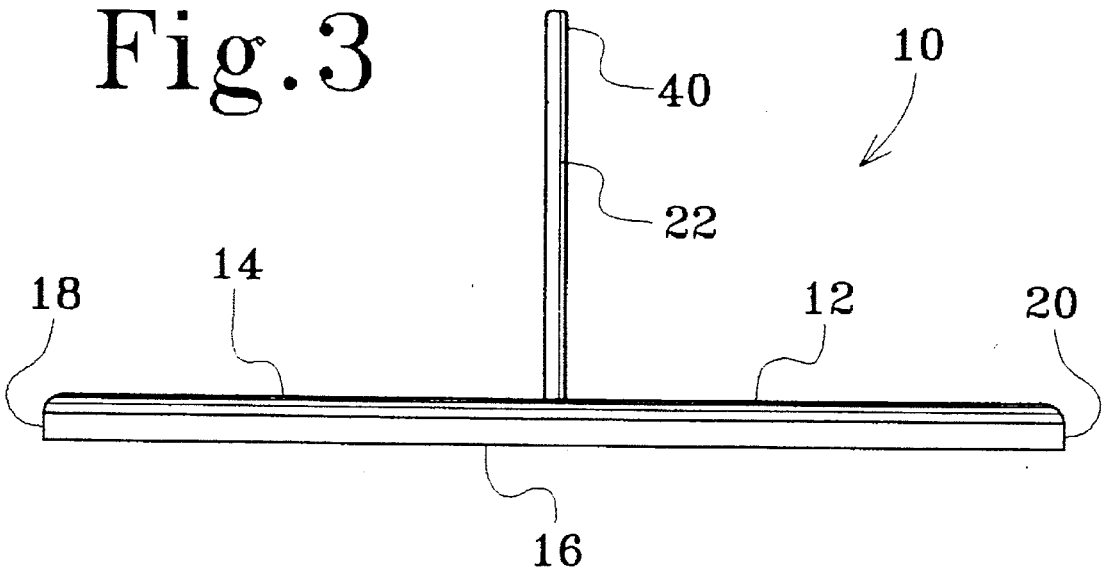
FIG. 3 illustrates a side elevation view of a bow making apparatus of the present invention.
Figure 7:
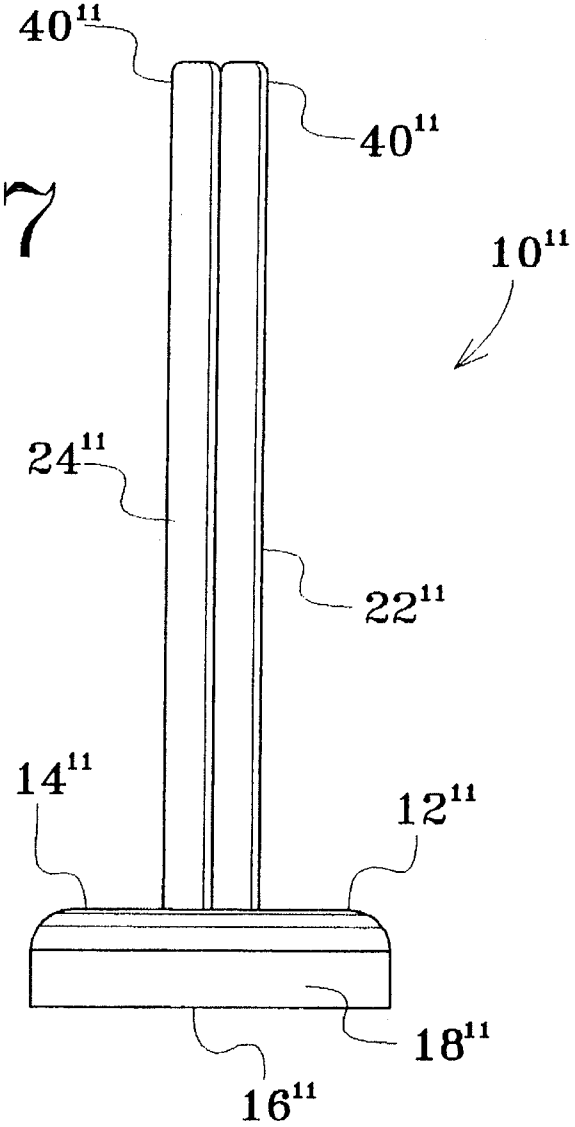
FIG. 7 illustrates an end view of a further alternate embodiment of a bow making apparatus of the present invention.

In the illustrated embodiment of FIG. 1 the retainer members 22 and 24 are selectively spaced so as to define a retaining gap 26 therebetween for releasably receiving the ribbon or other bow fabricating material being used. However, in FIG. 7 an alternate embodiment of the apparatus is illustrated at $\mathbf{10}^{11}$ wherein the retainer members $\mathbf{22}^{11}$ and $\mathbf{24}^{11}$ are positioned such that no gap 26 is defined therebetween. In this regard, where a bow is being fabricated of thin ribbon or other thin bow fabricating material the abutting retainer members $\mathbf{22}^{11}$ and $\mathbf{24}^{11}$ serve to more securely hold the bow fabricating material.

Figure 9:
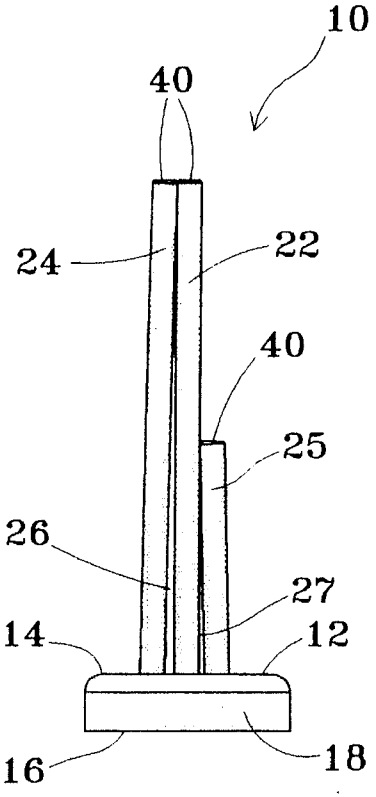
FIG. 9 illustrates an end view of the bow making apparatus of the present invention illustrated in FIG. 8.

As illustrated in FIG. 9, the retainer members 22 and 25 are selectively spaced so as to define a retaining gap 27. Though not shown, it is envisioned that no retaining gap 27 may be defined therebetween as illustrated in the embodiment described above and illustrated in FIG. 7. The retaining gap in the preferred embodiment, is substantially proportionate to the retaining gap 26 according to the relative proportions of the retaining member 22 and the retaining member 25. In the illustrated embodiment, the retaining gap 27 is approximately one-half the width of the retaining gap 26. The shorter height of the retaining member 25 and the narrower retaining gap 27 combine to provide a more appropriate device for fabricating decorative bows from a narrower bow fabricating material 28 than that used to fabricate decorative bows using the retaining members 22 and 24. Specifically, the shorter retaining member 25 allows shorter loops to be fabricated, while the narrower retaining gap 27 more closely gathers a narrower material 28.

As illustrated in FIG. 1, the retainer members 22 and 24, or the retainer members 22 and 25, engage the bow fabricating material 28 at the point at which the material is gathered 35, i.e. the point at which bow is to be bound together with a wire or other securing means. More specifically, in relation to the present invention, the gathered portions 35 of the material 28 are defined as the midpoints of the material 28 between successive loops which are contacted and retained by the retainer members 22 and 24, or 22 and 25. Therefore, the spacing of the retainer members 22 and 24 is such that the gathered bow fabricating material 28 is securely, yet releasably held between the retainer members 22 and 24 as the bow making operation proceeds. Likewise, the spacing of the retainer members 22 and 25 is such that the gathered bow fabricating material 28 is securely, yet releasably held between the retainer members 22 and 25 as the bow making operation proceeds.

More specifically, FIG. 1 illustrates one possible bow making operation which can be performed utilizing the apparatus 10 and illustrates the function of the retainer members 22 and 24 and the retaining gap 26. In accordance with the illustrated example, a first end 30 of a length of fabricating material 28 is placed on the work surface 14 between the retainer members 22, 24 and, for example, the second end 20 of the base member 12. At a preselected point along its length the fabricating material is gathered and inserted between the retainer members 22 and 24 as illustrated in FIG. 1 such that gathered portion 35 of the material 28 is maintained by the retainer members 22 and 24. Between the retainer members 22, 24 and the first end 18, and at a preselected point along the length of fabricating material 28, a first loop 32 is formed and the length of fabricating material is again gathered and passed between the retainer members 22 and 24 at a preselected point along its length such that the retainer members 22 and 24 maintain the gathered portion 35 of the fabricating material 28 and, as a result, maintain the disposition of the first loop 32. A second loop 34 is then formed between the retainer members 22, 24 and the second end 20 and the fabricating material 28 is again gathered and passed between the retainer members 22 and 24. This process is repeated until the desired number of loops is formed on either side of the retainer members 22 and 24, with the retainer members 22 and 24 serving to maintain the gathered portions 35 of the fabricating material 28. The gathered portions 35 of the fabricating material 28 can then be removed from between the retainer members 22 and 24 for binding or the gathered portions 35 can be bound in place. A similar method is used for fabricating a decorative bow using the retainer members 22 and 25.

Figure 4:
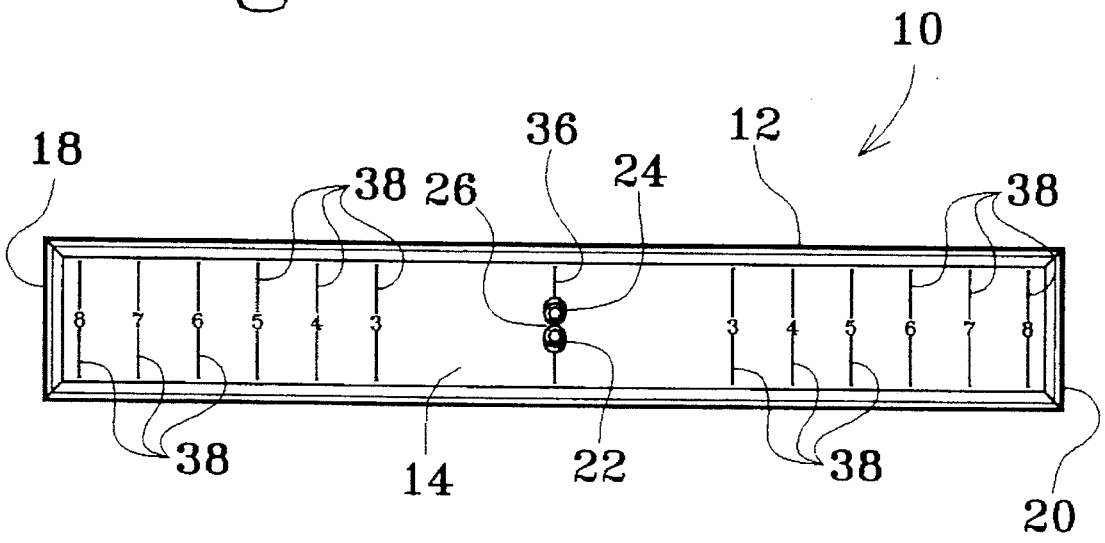
FIG. 4 illustrates a top plan view of a bow making apparatus of the present invention.

As best illustrated in FIG. 4, in the preferred embodiment of the apparatus 10 the upper work surface 14 is provided with measurement indicia which facilitates the fabrication of uniformly proportioned bows of a preselected size. For example, in the illustrated embodiment a center line 36 is provided which is aligned with the lower end of the gap 26. Further, between the center line 36 and the first and second ends be and 20 the work surface 14 is ruled with loop measuring lines 38 which indicate selected distances from the center line 36. For example, in the illustrated embodiment the loop measuring lines 38 on either side of the center line 36 are positioned at 1", 2", 3", 4", 5", 6", 7" and 8" from the center line 38, and numeric indicia are provided to facilitate the use of the ruled surface.

It will be appreciated that the indicia provided on the work surface 14 facilitates the making of bows with uniform proportions and/or bows having loops of selected lengths. It will also be appreciated that the units of measure depicted on the work surface can be metric or based upon some other measurement system.

Figure 5:
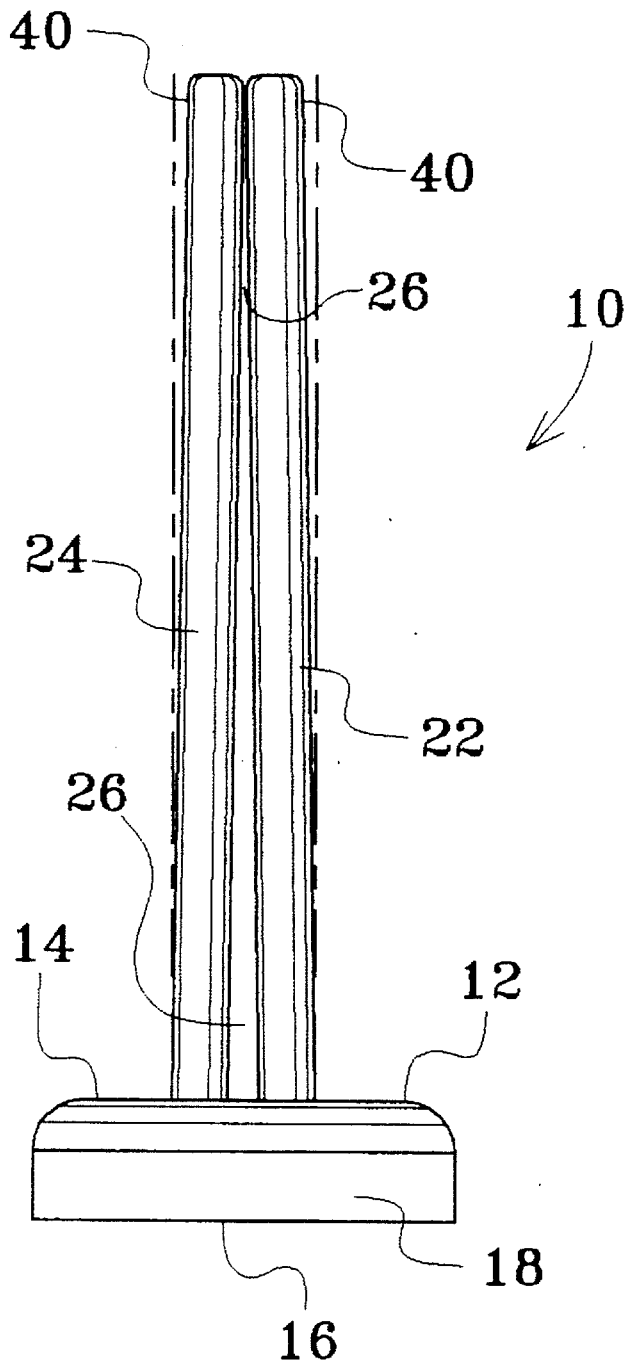
FIG. 5 illustrates an end view of a bow making apparatus of the present invention.
Figure 6:
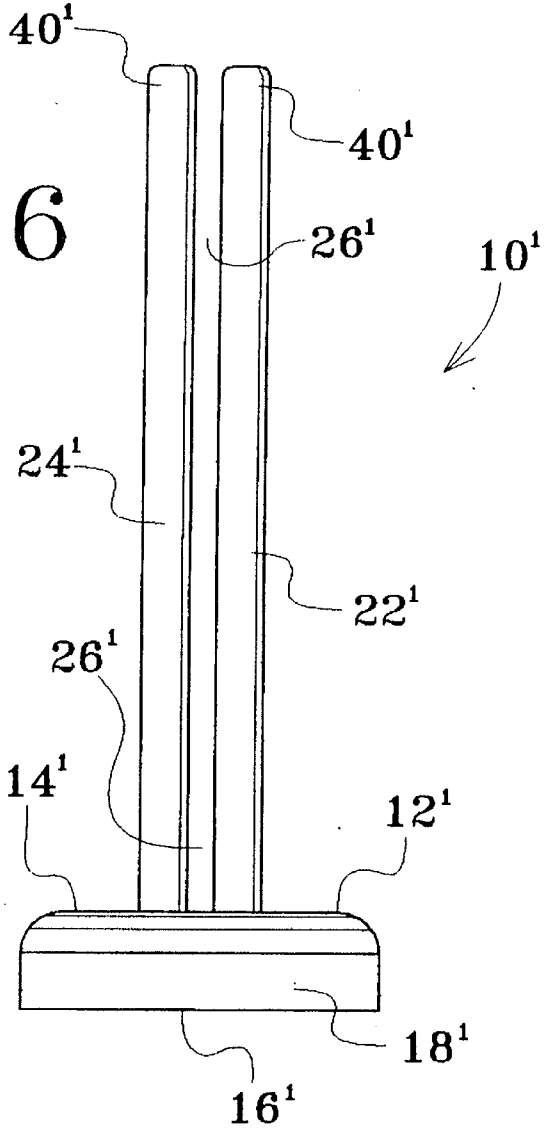
FIG. 6 illustrates an end view of an alternate embodiment of a bow making apparatus of the present invention.

Referring now to FIG. 5, it will be noted that in one preferred embodiment of the apparatus 10 the retainer members 22 and 24 are disposed at preselected angles such that the retaining gap 26 narrows toward the distal ends 40 of the retainer members. In this regard, as bow fabricating material is received between the retainer members 22 and 24 there is a tendency for the retainer members 22 and 24 to bend outwardly, and the angling of the retainer members helps compensate for this tendency and insures that the fabricating material is firmly maintained between the retainer members 22 and 24. Typically, the inward angle of each of the retainer members 22 and 24 is between 1° and 5°, but other angles may be suitable. However, as illustrated in FIG. 6, where an alternate embodiment of the apparatus is referenced at $\mathbf{10}^1$, the retainer members $\mathbf{22}^1$ and $\mathbf{24}^1$ can be disposed perpendicular to the work surface $\mathbf{14}^1$ and parallel to one another if desired.

In the embodiment illustrated in FIG. 9, the retaining member 22 is oriented substantially perpendicular to the work surface 14, with the retainer members 24 and 25 being oriented at an inward angle thereto so as to define a relative angle with respect to the retaining member 22 as in the previously described embodiment, and specifically, such that the distal ends 40 of the retaining members 22 and 24 are proximate each other and the distal end 40 of the retaining member 25 is proximate the retaining member 22 at an approximate mid-point.

While fabricating decorative bows, the length of successive loops is selected in accordance with the desired overall look of the finished bow. For example, as illustrated in FIG. 1, the first and second loops 30 and 32 define substantially equal lengths. It is envisioned that several other successive loops may form equal lengths to those. However, it is also envisioned that further successive loops may define proportionately shorter lengths such that the finished decorative bow is fuller, with the shorter loops filling the middle portion of the bow. The variations in the lengths of the loops in infinite.

In light of the above it will be recognized that the present invention provides a bow making apparatus having great advantages over the prior art. The apparatus 10 obviates the need for the bow maker to grasp and maintain the successive gathered portions of the bow during the formation of a plurality of loops. Further, it facilitates the making of bows with uniform proportions and having loops of preselected sizes. The apparatus also facilitates the making of decorative bows of varying sizes, using fabricating materials of varying weights and widths. However, while a preferred embodiment has been shown and described, it will be understood that there is no intent to limit the invention to such disclosure, but rather it is intended to cover all modifications and alternate constructions falling within the spirit and scope of the invention as defined in the appended claims.

Having thus described the aforementioned invention, I claim:

1. A bow making apparatus for receiving and maintaining the disposition of bow fabricating material during the making of a decorative bow, such decorative bow defining looped portions of bow fabricating material and gathered sections of bow fabricating material at an approximate midpoint between successive of the looped portions, said apparatus comprising:

a base member defining an upper work surface for supporting the bow fabricating material during the making of a decorative bow;

a first and a second retainer member for contacting and releasably receiving therebetween the gathered sections of bow fabricating material, said first and second retainer members extending upwardly from said upper work surface of said base member from a proximal end of said first and second retainer members to a distal end of said first and second retainer members, whereby the gathered sections of bow fabricating material are releasably maintained in a gathered disposition, said first and second retainer members being selectively spaced so as to define a first retaining gap therebetween for releasably receiving the gathered sections of bow fabricating material whereby the gathered sections of bow fabricating material are releasably maintained in a gathered disposition, said first and second retainer members defining elongated rods having distal ends, said first and second retainer members being disposed at preselected angles such that said first retaining gap narrows toward said distal ends of said first and second retainer members whereby such angular disposition of said first and second retainer members compensates for outward bending of said first and second retainer members; and a third retainer member for contacting and releasably receiving the gathered sections of bow fabricating material between said second retainer member and said third retainer member, said third retainer member extending upwardly from said upper work surface of said base member from a proximal end of said third retainer member to a distal end of said third retainer member, whereby the gathered sections of bow fabricating material are releasably maintained in a gathered disposition, said second and third retainer members being selectively spaced so as to define a second retaining gap therebetween for contacting and releasably receiving the gathered sections of bow fabricating material whereby the gathered sections of bow fabricating material are contacted and releasably maintained in a gathered disposition, said third retainer member defining elongated rods having a distal end, said second and third retainer members being disposed at preselected angles such that said second retaining gap narrows toward said distal end of said third retainer member whereby such angular disposition of said second and third retainer members compensates for outward bending of said second and third retainer members.

2. The apparatus of claim 1 wherein said first and second retainer members define substantially equal lengths, and wherein said third retainer member defines a length of approximately one-half said length of said first and second retainer members.

3. The apparatus of claim 1 wherein said upper work surface of said base member is provided with indicia for facilitating the making of bows having looped portions of preselected length.

4. The apparatus of claim 3 wherein said indicia includes a plurality of loop measuring lines disposed between said center line and a first end of said base member at preselected distances from said center line, and a plurality of loop measuring lines disposed between said center line and a second end of said base member at preselected distances from said center line.

5. A bow making apparatus for receiving and maintaining the disposition of bow fabricating material during the making of a decorative bow, such decorative bow defining looped portions of bow fabricating material and gathered sections of bow fabricating material at an approximate midpoint between successive of the looped portions, said apparatus consisting essentially of:

a base member defining an upper work surface for supporting the bow fabricating material during the making of a decorative bow;

a first and a second retainer member for contacting and releasably receiving therebetween the gathered sections of bow fabricating material, said first and second retainer members extending upwardly from said upper work surface of said base member from a proximal end of said first and second retainer members to a distal end of said first and second retainer members, whereby the gathered sections of bow fabricating material are releasably maintained in a gathered disposition, said first and second retainer members being selectively spaced so as to define a first retaining gap therebetween for releasably receiving the gathered sections of bow fabricating material whereby the gathered sections of bow fabricating material are releasably maintained in a gathered disposition, said first and second retainer members defining elongated rods having distal ends, said first and second retainer members being disposed at preselected angles such that said first retaining gap narrows toward said distal ends of said first and second retainer members whereby such angular disposition of said first and second retainer members compensates for outward bending of said first and second retainer members; and a third retainer member for contacting and releasably receiving the gathered sections of bow fabricating material between said second retainer member and said third retainer member, said third retainer member extending upwardly from said upper work surface of said base member from a proximal end of said third retainer member to a distal end of said third retainer member, whereby the gathered sections of bow fabricating material are releasably maintained in a gathered disposition, said second and third retainer members being selectively spaced so as to define a second retaining gap therebetween for contacting and releasably receiving the gathered sections of bow fabricating material whereby the gathered sections of bow fabricating material are contacted and releasably maintained in a gathered disposition, said third retainer member defining elongated rods having a distal end, said second and third retainer members being disposed at preselected angles such that said second retaining gap narrows toward said distal end of said third retainer member whereby such angular disposition of said second and third retainer members compensates for outward bending of said second and third retainer members.

6. The apparatus of claim 5 wherein said first and second retainer members define substantially equal lengths, and wherein said third retainer member defines a length of approximately one-half said length of said first and second retainer members.

7. The apparatus of claim 5 wherein said upper work surface of said base member is provided with indicia for facilitating the making of bows having looped portions of preselected length.

8. The apparatus of claim 7 wherein said indicia includes a plurality of loop measuring lines disposed between said center line and a first end of said base member at preselected distances from said center line, and a plurality of loop measuring lines disposed between said center line and a second end of said base member at preselected distances from said center line.

9. A bow making apparatus for receiving and maintaining the disposition of bow fabricating material during the making of a decorative bow, such decorative bow defining looped portions of bow fabricating material and gathered sections of bow fabricating material at an approximate midpoint between successive of the looped portions, said apparatus comprising:

a base member defining an upper work surface for supporting the bow fabricating material during the making of a decorative bow, said upper work surface of said base member being provided with indicia for facilitating the making of bows having looped portions of preselected length; and a first and a second retainer member for contacting and releasably receiving therebetween the gathered sections of bow fabricating material, said first and second retainer members extending upwardly from said upper work surface of said base member from a proximal end of said first and second retainer members to a distal end of said first and second retainer members, whereby the gathered sections of bow fabricating material are releasably maintained in a gathered disposition, said first and second retainer members being selectively spaced so as to define a first retaining gap therebetween for releasably receiving the gathered sections of bow fabricating material whereby the gathered sections of bow fabricating material are releasably maintained in a gathered disposition, said first and second retainer members defining elongated rods having distal ends, said first and second retainer members being disposed at preselected angles such that said first retaining gap narrows toward said distal ends of said first and second retainer members whereby such angular disposition of said first and second retainer members compensates for outward bending of said first and second retainer members.

10. The apparatus of claim 9 wherein said indicia includes a plurality of loop measuring lines disposed between a center line and a first end of said base member at preselected distances from said center line, and a plurality of loop measuring lines disposed between said center line and a second end of said base member at preselected distances from said center line.

* * * * *

UNITED STATES PATENT AND TRADEMARK OFFICE
Certificate

Patent No. 5,617,979 Patented: April 8, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Deborah L. Cavender, Sevierville, TN; and Tina Lucille Benton Slater, Colbert, GA.

Signed and Sealed this Fourth Day of March 2003.

HENRY YUEN
*Supervisory Patent Examiner*
Art Unit 3747